US008632214B1

(12) United States Patent
Tickner et al.

(10) Patent No.: US 8,632,214 B1
(45) **Date of Patent: *Jan. 21, 2014**

(54) LIGHT MODULES WITH UNINTERRUPTED ARRAYS OF LEDS

(71) Applicants: Jerold Alan Tickner, Newnan, GA (US); Chun Wah Chan, Peachtree City, GA (US)

(72) Inventors: Jerold Alan Tickner, Newnan, GA (US); Chun Wah Chan, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/671,199

(22) Filed: Nov. 7, 2012

Related U.S. Application Data

(63) Continuation of application No. 12/617,127, filed on Nov. 12, 2009, now Pat. No. 8,308,320.

(51) Int. Cl.
*F21S 4/00* (2006.01)
*F21V 21/005* (2006.01)

(52) U.S. Cl.
USPC ..... 362/249.06; 362/249.02; 362/219; 362/217.17; 362/545

(58) Field of Classification Search
USPC ..... 362/612, 545, 97.3, 249.02, 249.06, 362/219, 217.17
See application file for complete search history.

(56) References Cited

U.S. PATENT DOCUMENTS

| | | | |
|---|---|---|---|
| 3,038,139 | A | 6/1962 | Bonanno |
| 3,706,882 | A | 12/1972 | Eby |
| 3,810,258 | A | 5/1974 | Mathauser |
| 4,302,800 | A | 11/1981 | Pelletier |
| 4,538,214 | A | 8/1985 | Fisher et al. |
| 4,617,612 | A | 10/1986 | Pritchett |
| 4,667,277 | A | 5/1987 | Hanchar |
| 4,719,549 | A | 1/1988 | Apel |
| 4,752,756 | A | 6/1988 | Bartel |
| 4,959,761 | A | 9/1990 | Critelli et al. |
| 5,154,509 | A | 10/1992 | Wulfman et al. |
| 5,161,882 | A | 11/1992 | Garrett |
| 5,291,039 | A | 3/1994 | Ogata et al. |
| 5,342,204 | A | 8/1994 | Och |
| 5,397,238 | A | 3/1995 | Och |
| 5,418,384 | A | 5/1995 | Yamana et al. |
| 5,559,681 | A | 9/1996 | Duarte |
| 5,660,461 | A | 8/1997 | Ignatius et al. |
| 6,050,044 | A | 4/2000 | McIntosh |
| 6,176,760 | B1 | 1/2001 | Ngai |
| 6,233,971 | B1 | 5/2001 | Ohlund |
| 6,320,182 | B1 | 11/2001 | Hubble, III et al. |
| 6,343,942 | B1 | 2/2002 | Okamoto |
| 6,357,904 | B1 | 3/2002 | Kawashima |
| 6,361,186 | B1 | 3/2002 | Slayden |
| 6,367,948 | B2 | 4/2002 | Branson |
| 6,422,716 | B2 | 7/2002 | Henrici et al. |
| 6,426,807 | B1 | 7/2002 | Kawai et al. |

(Continued)

*Primary Examiner* — Ismael Negron
(74) *Attorney, Agent, or Firm* — King & Spalding LLP

(57) ABSTRACT

A light fixture includes multiple LED modules where each LED module includes a substrate on which one or more LED's are disposed. The LED modules can interface with one another in a variety of different configurations, such that when adjacent LED modules interface with one another, there is a substantially continuous array of LED's across the LED modules. Electrical connectors or other means for powering the LED modules are disposed such that they do not impact the continuity of light across adjacent LED modules.

20 Claims, 7 Drawing Sheets

(56) References Cited

U.S. PATENT DOCUMENTS

| | | | |
|---|---|---|---|
| 6,509,840 | B2 | 1/2003 | Martineau |
| 6,540,372 | B2 | 4/2003 | Joseph |
| 6,561,690 | B2 | 5/2003 | Balestriero et al. |
| 6,582,100 | B1 | 6/2003 | Hochstein et al. |
| 6,585,393 | B1 | 7/2003 | Brandes et al. |
| 6,592,238 | B2 | 7/2003 | Cleaver et al. |
| 6,601,970 | B2 | 8/2003 | Ueda et al. |
| 6,612,717 | B2 | 9/2003 | Yen |
| 6,641,284 | B2 | 11/2003 | Stopa et al. |
| 6,641,294 | B2 | 11/2003 | Lefebvre |
| 6,659,622 | B2 | 12/2003 | Katogi et al. |
| 6,676,284 | B1 | 1/2004 | Wynne Willson |
| 6,761,472 | B1 | 7/2004 | Cleaver et al. |
| 6,767,111 | B1 | 7/2004 | Lai |
| 6,776,504 | B2 | 8/2004 | Sloan et al. |
| 6,802,626 | B2 | 10/2004 | Belfer et al. |
| 6,882,111 | B2 | 4/2005 | Kan et al. |
| 6,932,495 | B2 | 8/2005 | Sloan et al. |
| 6,940,659 | B2 | 9/2005 | McLean et al. |
| 7,063,440 | B2 | 6/2006 | Mohacsi et al. |
| 7,066,739 | B2 | 6/2006 | McLeish |
| 7,070,418 | B1 | 7/2006 | Wang |
| 7,101,056 | B2 | 9/2006 | Pare |
| 7,137,727 | B2 | 11/2006 | Joseph et al. |
| 7,159,997 | B2 | 1/2007 | Reo et al. |
| 7,161,189 | B2 | 1/2007 | Wu |
| 7,163,404 | B2 | 1/2007 | Linssen et al. |
| 7,201,511 | B2 | 4/2007 | Moriyama et al. |
| 7,213,941 | B2 | 5/2007 | Sloan et al. |
| 7,241,031 | B2 | 7/2007 | Sloan et al. |
| 7,273,299 | B2 | 9/2007 | Parkyn et al. |
| 7,290,913 | B2 | 11/2007 | Watanabe et al. |
| 7,322,718 | B2 | 1/2008 | Setomoto et al. |
| 7,322,828 | B1 | 1/2008 | Chiang et al. |
| 7,322,873 | B2 | 1/2008 | Rosen et al. |
| 7,348,604 | B2 | 3/2008 | Matheson |
| 7,350,937 | B2 | 4/2008 | Yamamoto et al. |
| 7,377,669 | B2 | 5/2008 | Farmer et al. |
| 7,384,170 | B2 | 6/2008 | Skegin |
| 7,401,946 | B2 | 7/2008 | Laukhuf |
| 7,470,055 | B2 | 12/2008 | Hacker et al. |
| 7,478,920 | B2 | 1/2009 | Nanbu |
| 7,506,995 | B2 | 3/2009 | Thomas et al. |
| 7,538,356 | B2 | 5/2009 | Lai |
| 7,549,779 | B2 | 6/2009 | Genenbacher |
| 7,572,027 | B2 | 8/2009 | Zampini, II et al. |
| 7,625,104 | B2 | 12/2009 | Zhang et al. |
| 7,677,914 | B2 | 3/2010 | Nall et al. |
| 7,703,941 | B2 | 4/2010 | Lee |
| 7,726,840 | B2 | 6/2010 | Pearson et al. |
| 7,726,974 | B2 | 6/2010 | Shah et al. |
| 7,731,558 | B2 | 6/2010 | Capriola |
| 7,789,529 | B2 | 9/2010 | Roberts et al. |
| 7,791,089 | B2 | 9/2010 | Bisberg |
| 7,806,569 | B2 | 10/2010 | Sanroma et al. |
| 7,806,574 | B2 | 10/2010 | Van Laanen et al. |
| 7,815,341 | B2 | 10/2010 | Steedly et al. |
| 7,857,482 | B2 | 12/2010 | Reo et al. |
| 8,052,299 | B2 | 11/2011 | Lin |
| 2002/0093832 | A1 | 7/2002 | Hamilton |
| 2003/0048641 | A1 | 3/2003 | Alexanderson et al. |
| 2003/0081419 | A1 | 5/2003 | Jacob et al. |
| 2003/0174517 | A1 | 9/2003 | Kiraly et al. |
| 2003/0223235 | A1 | 12/2003 | Mohacsi et al. |
| 2004/0076004 | A1 | 4/2004 | Smith, Jr. |
| 2004/0114355 | A1 | 6/2004 | Rizkin et al. |
| 2004/0161213 | A1 | 8/2004 | Lee |
| 2004/0201980 | A1 | 10/2004 | Fischer et al. |
| 2005/0146899 | A1 | 7/2005 | Joseph et al. |
| 2005/0157500 | A1 | 7/2005 | Chen et al. |
| 2005/0162265 | A1 | 7/2005 | Werner et al. |
| 2005/0264473 | A1 | 12/2005 | Sibbett |
| 2006/0093308 | A1 | 5/2006 | Ryan |
| 2006/0146531 | A1 | 7/2006 | Reo et al. |
| 2006/0262533 | A1 | 11/2006 | Lin et al. |
| 2007/0147030 | A1 | 6/2007 | Lee et al. |
| 2007/0190845 | A1 | 8/2007 | Mrakovich et al. |
| 2008/0030981 | A1 | 2/2008 | Mrakovich et al. |
| 2008/0094828 | A1 | 4/2008 | Shao |
| 2008/0158878 | A1 | 7/2008 | Van Laanen et al. |
| 2008/0170367 | A1 | 7/2008 | Lai |
| 2008/0244944 | A1 | 10/2008 | Nall et al. |
| 2008/0298058 | A1 | 12/2008 | Kan et al. |
| 2009/0021936 | A1 | 1/2009 | Stimac et al. |
| 2009/0073693 | A1 | 3/2009 | Nall et al. |
| 2009/0101921 | A1 | 4/2009 | Lai |
| 2009/0161371 | A1 | 6/2009 | Vukosic et al. |
| 2009/0224265 | A1 | 9/2009 | Wang et al. |
| 2009/0237011 | A1 | 9/2009 | Shah et al. |
| 2009/0238252 | A1 | 9/2009 | Shah et al. |
| 2009/0240380 | A1 | 9/2009 | Shah et al. |
| 2009/0279298 | A1 | 11/2009 | Mier-Langner et al. |
| 2009/0290348 | A1 | 11/2009 | Van Laanen et al. |
| 2009/0303712 | A1 | 12/2009 | Wung et al. |
| 2009/0310335 | A1 | 12/2009 | Park |
| 2010/0002450 | A1 | 1/2010 | Pachler et al. |
| 2010/0053956 | A1 | 3/2010 | Park et al. |
| 2010/0073931 | A1 | 3/2010 | Watanabe |
| 2010/0103672 | A1 | 4/2010 | Thomas et al. |
| 2010/0103687 | A1 | 4/2010 | Pitlor |
| 2010/0110680 | A1 | 5/2010 | Bianco et al. |
| 2010/0118532 | A1 | 5/2010 | Liang et al. |
| 2010/0124067 | A1 | 5/2010 | Hente et al. |
| 2010/0135022 | A1 | 6/2010 | Deguara |
| 2010/0164409 | A1 | 7/2010 | Lo et al. |
| 2010/0182782 | A1 | 7/2010 | Ladewig |
| 2010/0182788 | A1 | 7/2010 | Luo et al. |
| 2010/0188846 | A1 | 7/2010 | Oda et al. |
| 2010/0195322 | A1 | 8/2010 | Kawakami et al. |
| 2010/0201269 | A1 | 8/2010 | Tzou et al. |
| 2010/0214747 | A1 | 8/2010 | Jacobs et al. |
| 2010/0214779 | A1 | 8/2010 | Kao |
| 2010/0220479 | A1 | 9/2010 | Yamashita et al. |
| 2010/0226125 | A1 | 9/2010 | Liao et al. |
| 2010/0232154 | A1 | 9/2010 | Chen |
| 2010/0254134 | A1 | 10/2010 | Mccanless |
| 2010/0271804 | A1 | 10/2010 | Levine |
| 2010/0271834 | A1 | 10/2010 | Muessli |
| 2010/0277098 | A1 | 11/2010 | Sarna |
| 2010/0277666 | A1 | 11/2010 | Bertram et al. |
| 2010/0277913 | A1 | 11/2010 | Ward |
| 2010/0308350 | A1 | 12/2010 | Bisberg |
| 2011/0013377 | A1 | 1/2011 | Kim |
| 2011/0019417 | A1 | 1/2011 | Van Laanen et al. |

LIGHT MODULES WITH UNINTERRUPTED ARRAYS OF LEDS

RELATED APPLICATIONS

This application is a continuation of and claims priority under 35 U.S.C. §120 to U.S. patent application Ser. No. 12/617,127, titled "Light Emitting Diode Module" and filed Nov. 12, 2009, the entire contents of which are hereby incorporated herein by reference.

TECHNICAL FIELD

The invention relates generally to light emitting diodes ("LED's") and more particularly to LED modules that interface with one another in a variety of different configurations to provide a substantially continuous array of LED's across the LED modules.

BACKGROUND

The use of LED's in place of conventional incandescent, fluorescent, and neon lamps has a number of advantages. LED's tend to be less expensive and longer lasting than conventional incandescent, fluorescent, and neon lamps. In addition, LED's generally can output more light per watt of electricity than incandescent, fluorescent, and neon lamps.

Linear light fixtures are popular for a variety of different residential and commercial lighting applications, including cabinet lighting, shelf lighting, cove lighting, and signage. Cove lighting is a form of indirect lighting in which lamps are built into ledges, recesses, or valences in a ceiling or high on the walls of a room. Linear light fixtures can provide primary lighting in an environment or serve as aesthetic accents or designs that complement other lighting sources.

Conventional linear LED light fixtures include modules or strips of LED's that are mechanically and electrically coupled to one another in an end-to-end relationship. FIG. 1 illustrates two conventional LED strips 105 and 106 that could be used in such a light fixture. Each strip 105, 106 includes multiple LED's 108. A second end 105*b* of strip 105 is electrically and mechanically coupled to a first end 106*a* of strip 106 via a connector 110. Adjacent pairs of LED's 108*a*-108*d* on strip 105 are spaced apart from one another by a distance X. Adjacent pairs of LED's 108*e*-108*h* on strip 106 are spaced apart from one another by the same distance X.

Adjacent LED's 108*d* and 108*e* across the LED strips 105 and 106 are spaced apart from one another by a distance Y. The distance Y is significantly larger than the distance X. This space between the LED's 108*d* and 108*e* causes the light output by the LED strips 105 and 106 to be discontinuous. In particular, the light output by the LED strips 105 and 106 includes an undesirable break or shadow that corresponds to the space between the LED strips 105 and 106.

Therefore, a need exists in the art for an improved linear LED light fixture. In particular, a need exists in the art for LED modules that interface with one another in a way that produces continuous light output across the LED modules. A further need exists in the art for such light output to be devoid of undesirable shadows and breaks.

SUMMARY

The invention provides an improved linear LED light fixture. In particular, the invention provides LED modules that interface with one another in a variety of different configurations to provide a substantially continuous array of LED's across the LED modules. This continuity in the array of the LED's enables the LED modules to output continuous light across the LED modules, without any undesirable shadows or breaks.

Each LED module includes a substrate on which one or more LED's are disposed. The LED modules can interface with one another in a substantially continuous, end-to-end relationship. For example, each substrate can include a notch or protrusion in which a corresponding protrusion or notch of an adjacent substrate may be disposed. When adjacent LED modules interface with one another, there is a substantially continuous array of LED's across the LED modules. For example, one or more rows or patterns of LED's may continue, substantially uninterrupted, within and across the LED modules.

The LED modules may be powered using electrical connectors, which electrically couple together adjacent LED modules. Each electrical connector can be coupled to its associated LED modules at locations other than the ends at which the LED modules interface with one another. Thus, unlike with the conventional LED strips 105 and 106 depicted in FIG. 1, the electrical connectors do not impact the continuity of light across adjacent LED modules. In addition to, or instead of, electrical connectors, powered surfaces, such as rails and tracks, may power the LED modules. For example, the LED modules may be coupled to the powered surfaces.

A light fixture may include multiple LED modules mounted to a surface. For example, the LED modules may be removably coupled to the surface using screws, nails, or other fastening devices. The light fixture may be a linear or non-linear light fixture used in residential, commercial, or other lighting applications.

These and other aspects, features and embodiments of the invention will become apparent to a person of ordinary skill in the art upon consideration of the following detailed description of illustrated embodiments exemplifying the best mode for carrying out the invention as presently perceived.

BRIEF DESCRIPTION OF THE DRAWINGS

For a more complete understanding of the present invention and the advantages thereof, reference is now made to the following description, in conjunction with the accompanying figures briefly described as follows.

DETAILED DESCRIPTION OF EXEMPLARY EMBODIMENTS

The invention is directed to LED modules that interface with one another in a variety of different configurations to provide a substantially continuous array of LED's across the LED modules. This continuity in the array of the LED's enables the LED modules to output continuous light across the LED modules, without any undesirable shadows or breaks. The LED modules can provide light in any of a number of different residential and commercial lighting applications. For example, the LED modules can be installed on any surface to provide cabinet lighting, shelf lighting, cove lighting, and signage.

Figure 1:
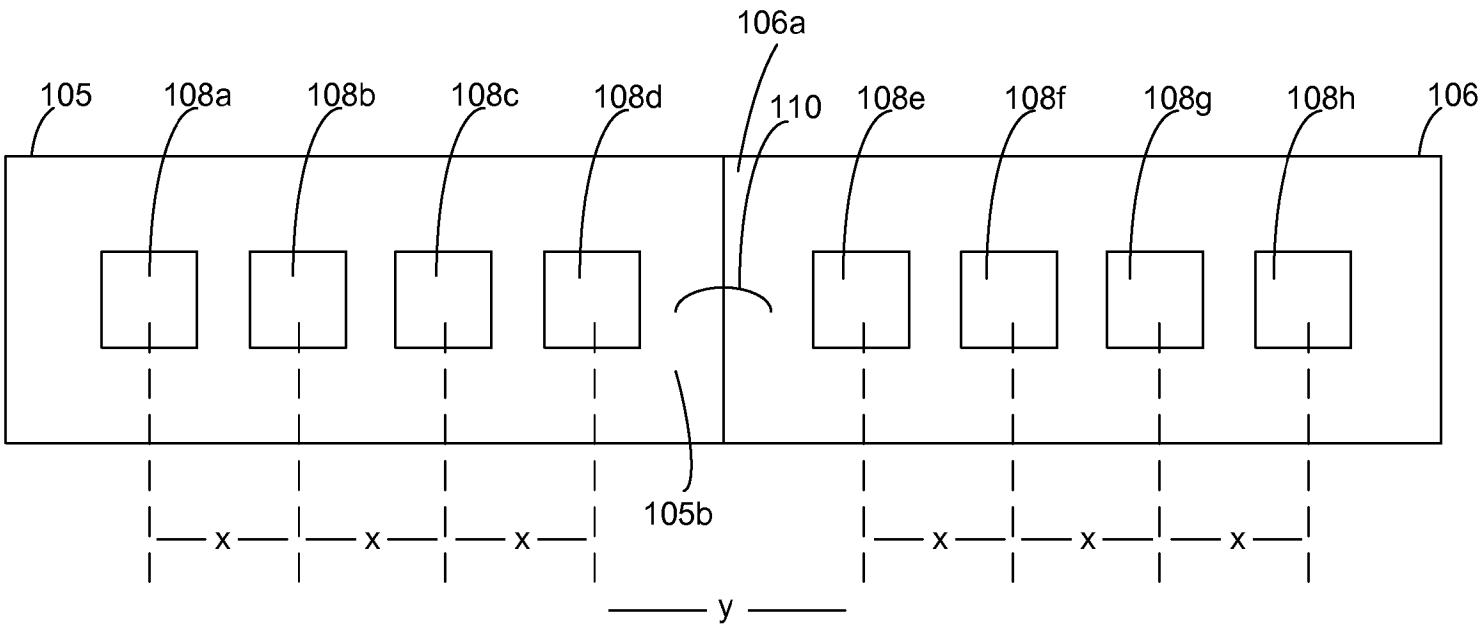
Fig. 1 (Prior Art)
FIG. 1 is a block diagram that illustrates conventional LED strips of a linear light fixture.
Figure 2:
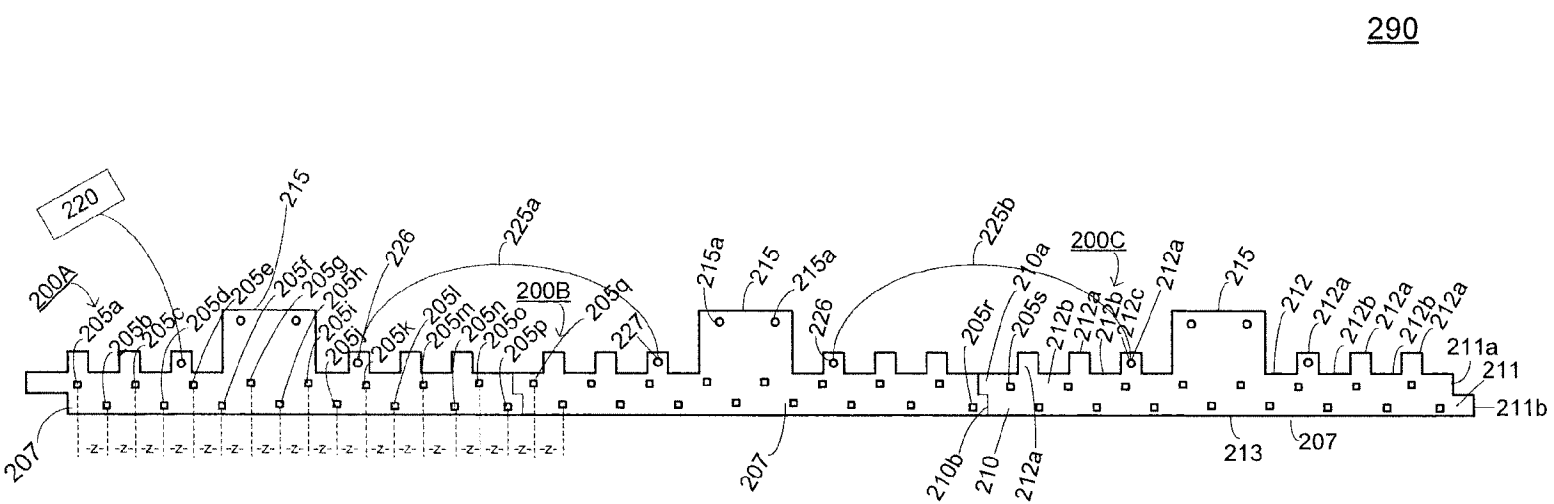
FIG. 2 is a top elevational view of an LED assembly, which includes linear LED modules, in accordance with certain exemplary embodiments.
Figure 3:
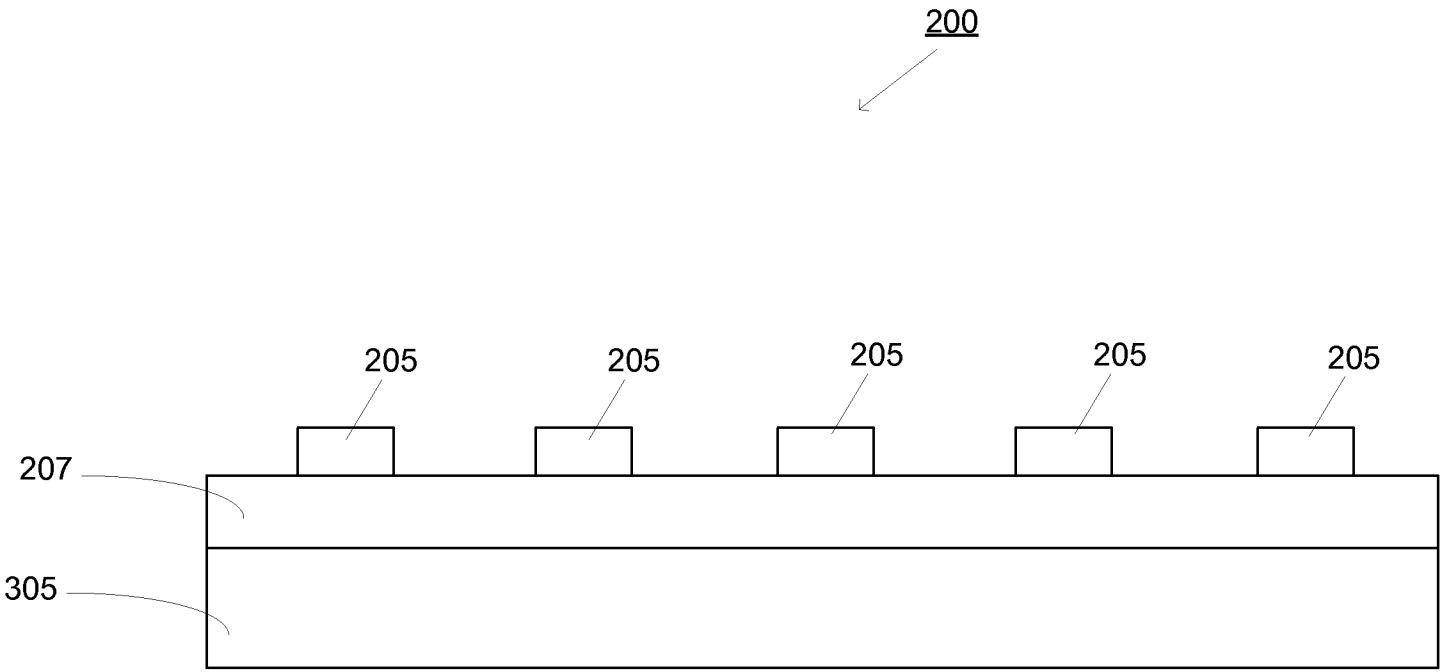
FIG. 3 is a side elevational view of one of the linear LED modules depicted in FIG. 2, in accordance with certain exemplary embodiments.

Turning now to the drawings, in which like numerals indicate like elements throughout the figures, exemplary embodiments of the invention are described in detail. FIG. 2 is a top elevational view of an LED assembly 290, which includes LED modules 200, in accordance with certain exemplary embodiments. FIG. 3 is a side elevational view of one of the LED modules 200, in accordance with certain exemplary embodiments. With reference to FIGS. 2 and 3, each LED module 200 is configured to create artificial light or illumination via multiple LED's 205. For purposes of this application, each LED 205 may be a single LED die or may be an LED package having one or more LED dies on the package. In certain exemplary embodiments, the number of dies on each LED package ranges from 1-312. For example, each LED package may include 2 dies.

Each LED module 200 includes at least one substrate 207 to which the LED's 205 are coupled. Each substrate 207 includes one or more sheets of ceramic, metal, laminate, circuit board, flame retardant (FR) board, mylar, or other material. Although depicted in FIGS. 2 and 3 as having a substantially rectangular shape, a person of ordinary skill in the art having the benefit of the present disclosure will recognize that the substrate 207 can have any linear or non-linear shape. Each LED 205 is attached to its respective substrate 207 by a solder joint, a plug, an epoxy or bonding line, or other suitable provision for mounting an electrical/optical device on a surface. Each LED 205 includes semi-conductive material that is treated to create a positive-negative (p-n) junction. When the LED's 205 are electrically coupled to a power source 220, such as a driver, current flows from the positive side to the negative side of each junction, causing charge carriers to release energy in the form of incoherent light.

The wavelength or color of the emitted light depends on the materials used to make each LED 205. For example, a blue or ultraviolet LED typically includes gallium nitride (GaN) or indium gallium nitride (InGaN), a red LED typically includes aluminum gallium arsenide (AlGaAs), and a green LED typically includes aluminum gallium phosphide (AlGaP). Each of the LED's 205 is capable of being configured to produce the same or a distinct color of light. In certain exemplary embodiments, the LED's 205 include one or more white LED's and one or more non-white LED's, such as red, yellow, amber, green, or blue LED's, for adjusting the color temperature output of the light emitted from the LED modules 200. A yellow or multi-chromatic phosphor may coat or otherwise be used in a blue or ultraviolet LED 205 to create blue and red-shifted light that essentially matches blackbody radiation. The emitted light approximates or emulates "white," light to a human observer. In certain exemplary embodiments, the emitted light includes substantially white light that seems slightly blue, green, red, yellow, orange, or some other color or tint. In certain exemplary embodiments, the light emitted from the LED's 205 has a color temperature between 2500 and 6000 degrees Kelvin.

In certain exemplary embodiments, an optically transmissive or clear material (not shown) encapsulates at least some of the LED's 205, either individually or collectively. This encapsulating material provides environmental protection while transmitting light from the LED's 205. For example, the encapsulating material can include a conformal coating, a silicone gel, a cured/curable polymer, an adhesive, or some other material known to a person of ordinary skill in the art having the benefit of the present disclosure. In certain exemplary embodiments, phosphors are coated onto or dispersed in the encapsulating material for creating white light.

Each LED module 200 includes one or more rows of LED's 205. The term "row" is used herein to refer to an arrangement or a configuration whereby one or more LED's 205 are disposed approximately in or along a line. LED's 205 in a row are not necessarily in perfect alignment with one another. For example, one or more LED's 205 in a row might be slightly out of perfect alignment due to manufacturing tolerances or assembly deviations. In addition, LED's 205 in a row might be purposely staggered in a non-linear or non-continuous arrangement. Each row extends along a longitudinal axis of the LED module 200.

Although depicted in FIG. 2 as having two staggered rows of LED's 205, a person of ordinary skill in the art having the benefit of the present disclosure will recognize that the LED's 205 can be arranged in any number of different rows, shapes, and configurations without departing from the spirit and scope of the invention. For example, the LED's 205 can be arranged in four different rows, with each row comprising LED's 205 of a different color. In certain exemplary embodiments, each row and/or each LED 205 is separately controlled by the driver so that each row can independently be turned on and off or otherwise reconfigured.

In the exemplary embodiment depicted in FIG. 2, each LED module 200 includes 16 LED's 205. The number of LED's 205 on each LED module 200 may vary depending on the size of the LED module 200, the size of the LED's 205, the amount of illumination required from the LED module 200, and/or other factors. For example, a larger LED module 200 with small LED's 205 may include more LED's 205 than a smaller LED module 200 with large LED's 205.

Adjacent pairs of LED's 205 on each LED module 200 are spaced apart from one another by a distance Z. Adjacent LED's 205*p* and 205*q* across LED modules 200A and 200B are spaced apart from one another by the same or substantially the same distance Z. Similarly, adjacent LED's 205*r* and 205*s* across LED modules 200B and 200C are spaced apart from one another by the same or substantially the same distance Z. Thus, all adjacent pairs of LED's 205 across the LED modules 200 are spaced apart by the same or substantially the same distance Z. This equal or substantially equal spacing across the LED modules 200 provides a continuous array of LED's 205 across the LED modules 200. Because the array is continuous, light output from the LED modules 200 is continuous, without any undesirable breaks or shadows. As described below with reference to FIG. 5, in certain alternative exemplary embodiments, the LED modules 200 can be configured to provide a substantially continuous array of LED's 205 without each adjacent pair of LED's 205 being equally spaced apart.

Ends 210 and 211 of each LED module 200 have profiles that enable adjacent pairs of the LED modules 200 to interface with one another. For example, in the embodiment depicted in FIG. 2, a first side end 210 of each LED module 200 includes a protrusion 210*a* that is sized and configured to be at least partially disposed adjacent a corresponding notch 211*a* in a second side end 211 of an adjacent LED module 200. Similarly, the second side end 211 of each LED module 200 includes a protrusion 211*b* that is sized and configured to be at least partially disposed adjacent a corresponding notch 210*b* in the first side end 210 of an adjacent LED module 200. Although depicted in FIG. 2 as substantially rectangular, the notches 210*b* and 211*a* and protrusions 210*a* and 211*b* in the LED modules 200 can have any size or shape. In addition, although depicted in FIG. 2 in an end-to-end relationship, adjacent LED modules 200 may interface one another in other configurations. For example, LED modules 200B and 200C may be arranged such that the protrusion 210*a* of LED module 200C rests at least partially adjacent the notch 211*a* or protrusion 211*b* of LED module B and a longitudinal axis of LED module 200C is disposed substantially perpendicular to a longitudinal axis of LED module 200B, substantially as described below with reference to FIG. 5.

A person of ordinary skill in the art having the benefit of the present disclosure will recognize that any of a number of other configurations of the adjacent ends 210 and 211 may be used to interface adjacent LED modules 200. For example, in certain alternative exemplary embodiments, the end of one LED module 200 can include multiple protrusions that are sized and configured to be disposed within corresponding notches in an adjacent LED module 200. Alternatively, in certain exemplary embodiments, one or both of the ends of each LED module 200 may have a substantially flat edge with not notches or protrusions. In certain alternative exemplary embodiments, only one of the ends 210 and 211 of each LED module 200 may have a profile that enables the LED module 200 to interface with another LED module 200. In certain exemplary embodiments, a top side end 212 of each LED module 200 includes one or more protrusions 212*a* and notches 212*b* sized and configured to engage one or more of the notches 210*b* and 211*a* and protrusions 210*a* and 211*b* in the side ends 210 and 211 of another, adjacent LED module 200.

In certain exemplary embodiments, adjacent LED modules 200 are electrically coupled to one another via a connector 225*a* or 225*b*. Each connector 225*a*, 225*b* can include one or more electrical wires, plugs, sockets, and/or other components that enable electrical transmission between electrical devices. In these exemplary embodiments, each connector 225*a*, 225*b* includes a first end 226 that is coupled to a protrusion 212*a* in a top side end 212 of one LED module 200 and a second end 227 that is coupled to a protrusion 212*a* in a top side end 212 of an adjacent LED module 200.

Because the connectors 225*a*, 225*b* extend from top side ends 212 of the LED modules 200, and not from interfacing side ends 210 and 211 of the LED modules 200, the LED modules 200 can engage one another without any significant gaps between the LED modules 200 or the pattern of LED's 205 on the LED modules 200. Thus, the LED modules 200 can provide a substantially continuous array or pattern of LED's 205 across the LED modules 200. A person of ordinary skill in the art having the benefit of the present disclosure will recognize that, in alternative exemplary embodiments, each connector 225*a*, 225*b* may be coupled to its corresponding LED modules 200 at other locations. For example, one or more of the connectors 225*a*, 225*b* can be connected to a bottom end 213 of an LED module 200. In certain alternative exemplary embodiments, the LED modules 200 can be mounted to a powered rail, track, or other device, which powers the LED modules 200 with using any connectors 225*a*, 225*b*.

Each LED module 200 is configured to be mounted to a surface (not shown) to illuminate an environment associated with the surface. For example, each LED module 200 may be mounted to, or within, a wall, counter, cabinet, sign, light fixture, or other surface. Each LED module 200 may be mounted to its respective surface using solder, braze, welds, glue, epoxy, rivets, clamps, screws, nails, or other fastening means known to a person of ordinary skill in the art having the benefit of the present disclosure. In certain exemplary embodiments, one or more of the LED modules 200 are removably mounted to their corresponding surfaces to enable efficient repair, replacement, and/or reconfiguration of the LED module(s) 200. For example, each LED module 200 may be removably mounted to its corresponding surface via one or more screws extending through openings 215*a* defined in protrusions 215 in the top side end 212 of the LED module 200.

To remove one of the LED modules 200, a person can simply disconnect the connector(s) 225*a* or 225*b* associated with the LED module 200 and unscrew the screws associated with the LED module 200. In certain exemplary embodiments, once the LED module 200 is removed, the remaining LED modules 200 may be electrically coupled to one another using one or more of the disconnected connectors 225*a* or 225*b*. For example, if a person removes LED module 200B, he can electrically couple LED module 200A to LED module 200C by connecting the connector 225*a* to the LED module 200C in place of the connector 225*b*.

The level of light a typical LED 205 outputs depends, in part, upon the amount of electrical current supplied to the LED 205 and upon the operating temperature of the LED 205. Thus, the intensity of light emitted by an LED 205 changes when electrical current is constant and the LED's 205 temperature varies or when electrical current varies and temperature remains constant, with all other things being equal. Operating temperature also impacts the usable lifetime of most LED's 205.

As a byproduct of converting electricity into light, LED's 205 generate a substantial amount of heat that raises the operating temperature of the LED's 205 if allowed to accumulate on the LED's 205, resulting in efficiency degradation and premature failure. Each LED module 200 is configured to manage heat output by its LED's 205. Specifically, each LED module 200 includes a conductive member 305 that is coupled to the substrate 207 and assists in dissipating heat generated by the LED's 205. Specifically, the member 305 acts as a heat sink for the LED's 205. The member 305 receives heat conducted from the LED's 205 through the substrate 207 and transfers the conducted heat to the surrounding environment (typically air) via convection.

Figure 4:
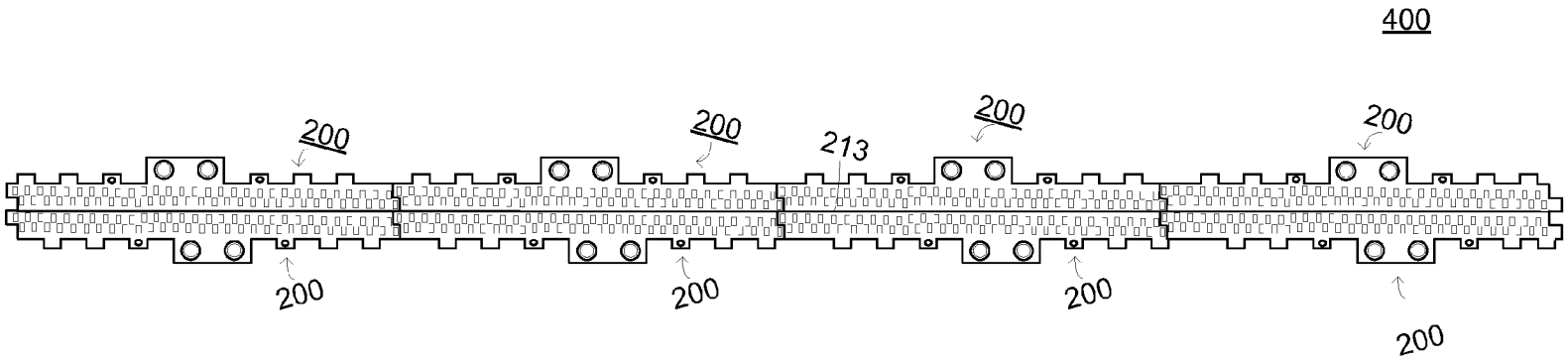
FIG. 4 is a top elevational view of an LED assembly, which includes multiple groupings of the linear LED modules depicted in FIG. 2, in accordance with certain exemplary embodiments.

FIG. 4 is a top elevational view of an LED assembly 400, which includes multiple groupings of the LED modules 200 depicted in FIG. 2, in accordance with certain exemplary embodiments. In addition to the interfaces at the side ends 210 and 211 of the LED modules, interfaces exist at bottom ends 213 of the LED modules 200. Specifically, a bottom end 213 of each LED module 200 engages a bottom end 213 of another, adjacent LED module 200. By interfacing the bottom ends 213, two adjacent LED modules 200 having a particular width can effectively constitute a single, continuous LED source that has a width that is twice the width of a single LED module.

Figure 5:
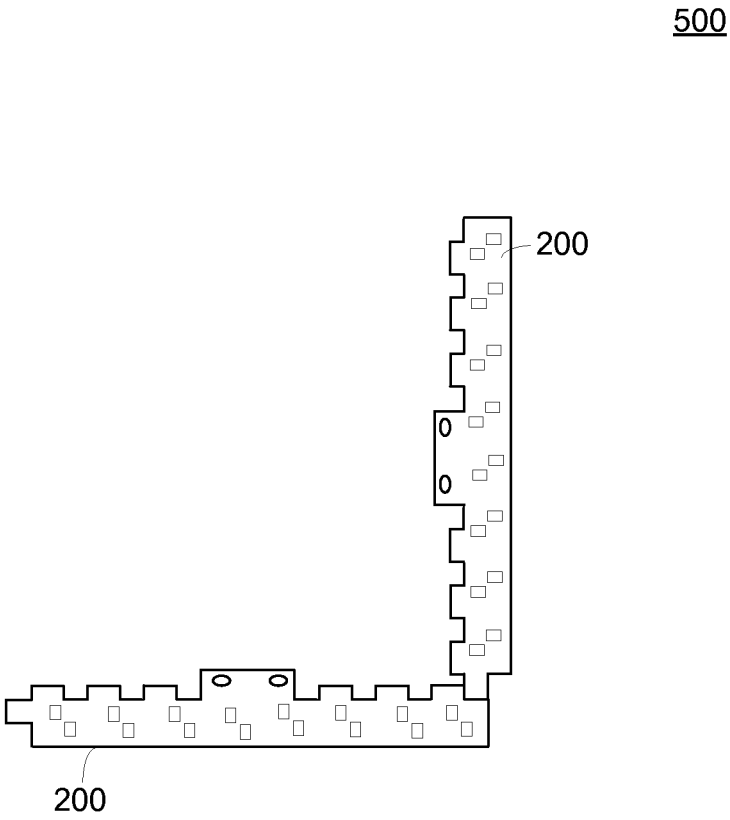
FIG. 5 is a top elevational view of an LED assembly, which includes LED modules arranged in an "L" shape, in accordance with certain exemplary embodiments.

The options for configuring and arranging multiple LED modules 200 with respect to one another are infinite. For example, multiple LED modules 200 can be arranged to form any of a variety of numbers, letters, shapes, etc. For example, FIG. 5 is a top elevational view of an LED assembly 500, which includes LED modules 200 arranged in an "L" shape, in accordance with certain exemplary embodiments. Thus, the LED modules 200 provide a flexible and efficient lighting option for both new lighting application installations and retro-fit applications. For example, in certain exemplary embodiments, LED modules 200 may be arranged on, and secured to, a member to be retro-fit into an existing light fixture.

Figure 6:
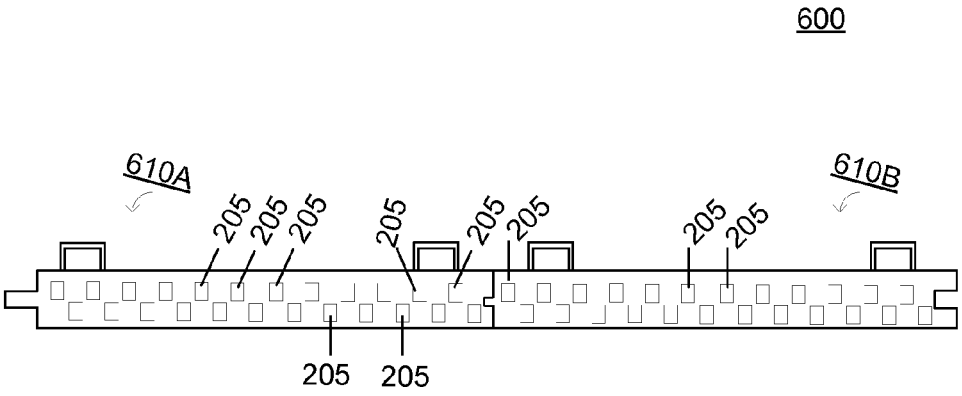
FIG. 6 is a top elevational view of an LED assembly of linear LED modules, in accordance with certain alternative exemplary embodiments.

FIG. 6 is a top elevational view of an LED assembly 600, which includes linear LED modules 610A and 610B, in accordance with certain alternative exemplary embodiments. Like the LED modules 200A-200C depicted in FIG. 2, each of the LED modules 610 includes one or more rows of LED's 205. Unlike the LED's 205 in the LED modules 200A-200C, the LED's 205 in the LED modules 610A and 610B are not equally spaced apart. Instead, the LED's 205 in the LED modules 610A and 610B are arranged in a pattern in which adjacent pairs of LED's 205 have different spacings. In certain exemplary embodiments, the pattern is predictable and repeated on the same LED module 610. In addition, or in the alternative, because the LED modules 610 interface one another without any gaps between the LED modules 610, the pattern may be repeated continuously across adjacent modules 610A and 610B.

Figure 7:
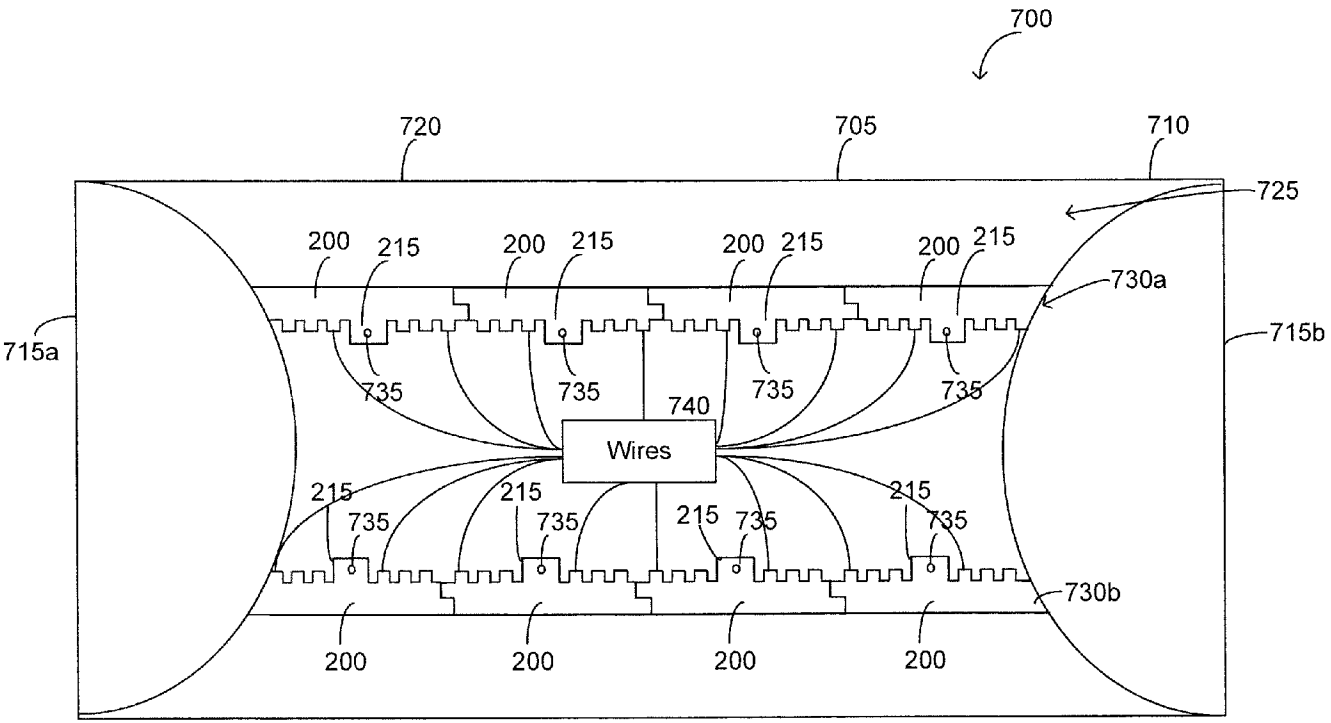
FIG. 7 is an elevational bottom view of a light fixture that includes the linear LED modules depicted in FIG. 2, in accordance with certain exemplary embodiments.

FIG. 7 is an elevational bottom view of a light fixture 700 that includes the linear LED modules 200 depicted in FIG. 2, in accordance with certain exemplary embodiments. The light fixture 700 includes a troffer 705 that includes a frame 710 having side ends 715*a* and 715*b* and a top 720 extending between the side ends 715*a* and 715*b*. In certain exemplary embodiments, each side end 715*a* and 715*b* extends from the top 720 at a substantially orthogonal angle. The side ends 715*a* and 715*b* and top 720 define an interior region 725.

Rows 730*a* and 730*b* of LED modules 200 extend within the interior region 725, substantially between the side ends 715*a* and 715*b*. Each LED module 200 is mounted to the top 720 via solder, braze, welds, glue, epoxy, rivets, clamps, screws, nails, or other fastening means known to a person of ordinary skill in the art having the benefit of the present disclosure. In certain exemplary embodiments, one or more of the LED modules 200 are removably mounted to the top 720 to enable efficient repair, replacement, and/or reconfiguration of the LED module(s) 200. For example, each LED module 200 may be removably mounted to the top 720 via one or more screws 735 extending through protrusions 215 of each LED module 200, substantially as described above. The LED modules 200 are electrically coupled to one another and to a power source (not shown) via one or more wires 740, substantially as described above.

The LED fixture 700 outputs light from the LED modules 200 into an environment associated with the LED fixture 700. Although FIG. 7 depicts a troffer LED fixture 700, a person of ordinary skill in the art having the benefit of the present disclosure will recognize that the LED modules 200 may be used in any other light fixture. For example, the LED modules 200 may be used in light fixtures for indoor and/or outdoor, commercial and/or residential applications.

Although specific embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the exemplary embodiments, in addition to those described above, can be made by a person of ordinary skill in the art, having the benefit of this disclosure, without departing from the spirit and scope of the invention defined in the following claims, the scope of which is to be accorded the broadest interpretation so as to encompass such modifications and equivalent structures.

What is claimed is:

1. A light emitting diode ("LED") luminaire, comprising:
a first module comprising
a protrusion extending out from an end of the first module; and
a first plurality of LEDs coupled to a top surface of the first module, at least one LED of the first plurality of LEDs being coupled to a top surface of the protrusion; and
a second module comprising
a notch extending inward from an end of the second module; and
a second plurality of LEDs coupled to a top surface of the second module,
wherein at least a portion of the protrusion of the first module extends into and is disposed within at least a portion of the notch of the second module, to provide a substantially continuous and uninterrupted array of LEDs across the first and second modules.

2. The LED luminaire of claim 1, further comprising a connector that electrically couples the first module to the second module.

3. The LED luminaire of claim 1, wherein
the first plurality of LEDs are arranged in at least a first row and the second plurality of LEDs are arranged in at least a second row,
the first and second rows being substantially aligned with one another when the protrusion of the first module is at least partially disposed within the notch of the second module.

4. The LED luminaire of claim 1, wherein an alignment pattern of the first plurality of LEDs on the first module continues substantially uninterrupted across the first module and the second module when the protrusion of the first module is at least partially disposed within the notch of the second module.

5. The LED luminaire of claim 1, further comprising a plurality of openings in each of the first and second modules.

6. The LED luminaire of claim 1, wherein the protrusion of the first module comprises a plurality of protrusions extending out from the end of the first module.

7. The LED luminaire of claim 1, wherein the notch of the second module comprises a plurality of notches extending inward from the end of the second module.

8. The LED luminaire of claim 1, further comprising a notch extending inward from the end of the first module and a protrusion extending out from the end of the second module.

9. A light emitting diode ("LED") luminaire, comprising:
a first module comprising
a protrusion extending out from an end of the first module; and
a first plurality of LEDs coupled to a top surface of the first module, at least one LED of the first plurality of LEDs being coupled to a top surface of the protrusion;
a second module comprising
a notch extending inward from an end of the second module; and
a second plurality of LEDs coupled to a top surface of the second module; and
a connector electrically coupling the first module to the second module,
wherein at least a portion of the protrusion of the first module extends into and is disposed within at least a portion of the notch of the second module, to provide a substantially continuous and uninterrupted array of LEDs across the first and second modules.

10. The LED luminaire of claim 9, wherein the first plurality of LEDs are arranged in at least a first row and the second plurality of LEDs are arranged in at least a second row, the first and second rows being substantially aligned with one another when the protrusion of the first module is at least partially disposed within the notch of the second module.

11. The LED luminaire of claim 9, wherein an alignment pattern of the first plurality of LEDs on the first LED module continues substantially uninterrupted across the first LED module and the second LED module when the protrusion of the first LED module is at least partially disposed within the notch of the second LED module.

12. The LED luminaire of claim 9, further comprising a plurality of openings in each of the first and second modules.

13. The LED luminaire of claim 9, wherein the protrusion of the first module comprises a plurality of protrusions extending out from the end of the first module.

14. The LED luminaire of claim 9, wherein the notch of the second module comprises a plurality of notches extending inward from the end of the second module.

15. The LED luminaire of claim 9, further comprising a notch extending inward from the end of the first module and a protrusion extending out from the end of the second module.

16. A light fixture, comprising:

a supporting surface; and a plurality of modules removably coupled to the supporting surface, each module comprising:

a plurality of LEDs coupled to a top surface of a substrate;

a notch extending inward from a first end of the substrate; and a protrusion extending out from a second end of the substrate, wherein at least one LED of the plurality of LEDs is coupled to a top surface of the protrusion, wherein adjacent ones of the modules interface with one another such that at least a portion of the protrusion of a first adjacent module extends into the notch of a second adjacent module to provide a substantially continuous and uninterrupted array of LEDs across the modules.

17. The light fixture of claim 16, further comprising at least one connector to electrically couple the modules, each connector being associated with a pair of adjacent modules.

18. The light fixture of claim 16, wherein the plurality of LEDs of the modules are arranged in at least one continuous row that extends across the modules.

19. The light fixture of claim 16, wherein an alignment pattern of the plurality of LEDs of the modules continues substantially uninterrupted across the modules.

20. The light fixture of claim 16, wherein a longitudinal distance between adjacent ones of the plurality of LEDs of the modules is substantially equal across the LED modules.

* * * * *